US006231432B1

(12) United States Patent
Peterson et al.

(10) Patent No.: US 6,231,432 B1
(45) Date of Patent: May 15, 2001

(54) FLOOR TREATMENT MACHINE WITH TORQUE LIMITER

(75) Inventors: Clay Peterson, Laguna Woods, CA (US); Michael A. Jackola, Somers, MT (US)

(73) Assignee: Pearl Abrasive Company, Commerce, CA (US)

( * ) Notice: Subject to any disclaimer, the term of this patent is extended or adjusted under 35 U.S.C. 154(b) by 0 days.

(21) Appl. No.: 09/439,118

(22) Filed: Nov. 12, 1999

(51) Int. Cl.[7] ..... B24B 23/00

(52) U.S. Cl. ..... 451/350; 451/351; 451/353; 15/49.1; 144/117.1

(58) Field of Search ..... 451/350, 351, 451/353, 559; 15/49.1, 98, 300.1; 144/117.1, 118, 119.1

(56) References Cited

U.S. PATENT DOCUMENTS

| | | | |
|---|---|---|---|
| 2,785,424 | | 3/1957 | McMaster et al. . |
| 3,552,070 | * | 1/1971 | Reiss . |
| 3,583,017 | | 6/1971 | Davis . |
| 4,138,804 | * | 2/1979 | Thielen . |
| 4,757,566 | * | 7/1988 | Field et al. . |
| 4,784,519 | * | 11/1988 | Artzberger . |
| 5,514,027 | * | 5/1996 | Pearlman . |
| 5,645,365 | | 7/1997 | Malish et al. . |

OTHER PUBLICATIONS

Power Transmission Components, Mayr Power Transmission Inc., Jan., 1998.

OPTI Torque Torque Limiters, Mayr Power Transmission, Inc., Oct., 1998.

Dalton Catalog No. 989—OSD Overload Safety Devices Torque Limiters—Couplings, Dalton Gear Company, Inc., date unknown.

Boston Centric Clutch Products, Boston Gear, Inc., 1998.

Torq–Tender Mechanical Torque Limiters, Zero–Max, Inc., 1996.

SePac, Inc. Clutches and Brakes brochure, 1999.

Smartflex brochure, Mayr Corp., undated.

* cited by examiner

*Primary Examiner*—Joseph J. Hail, III
*Assistant Examiner*—Willie Berry, Jr.
(74) *Attorney, Agent, or Firm*—Sheppard, Mullin, Richter & Hampton LLP; James R. Brueggemann

(57) ABSTRACT

A floor treatment machine with a torque limiter assembly between a rotating drive linkage and a rotating head for treating a floor surface. The torque limiter assembly includes engaged plates that disengage upon the application of a predetermined torque created when the head slows or stops rotating because of a floor obstruction. Upon the disengagement of the plates, the drive linkage continues to rotate and is less likely to sustain damage from the effect of the floor obstruction on the rotation of the head. The plates may engage each other through a configuration of cooperating teeth and notches. Alternatively, a rotating head can be provided with a built-in torque limiter assembly. This head can be attached to various floor treatment machines. The amount of predetermined torque that causes the plates to disengage may be adjusted as needed for varied floor conditions.

25 Claims, 5 Drawing Sheets

FIG. 1
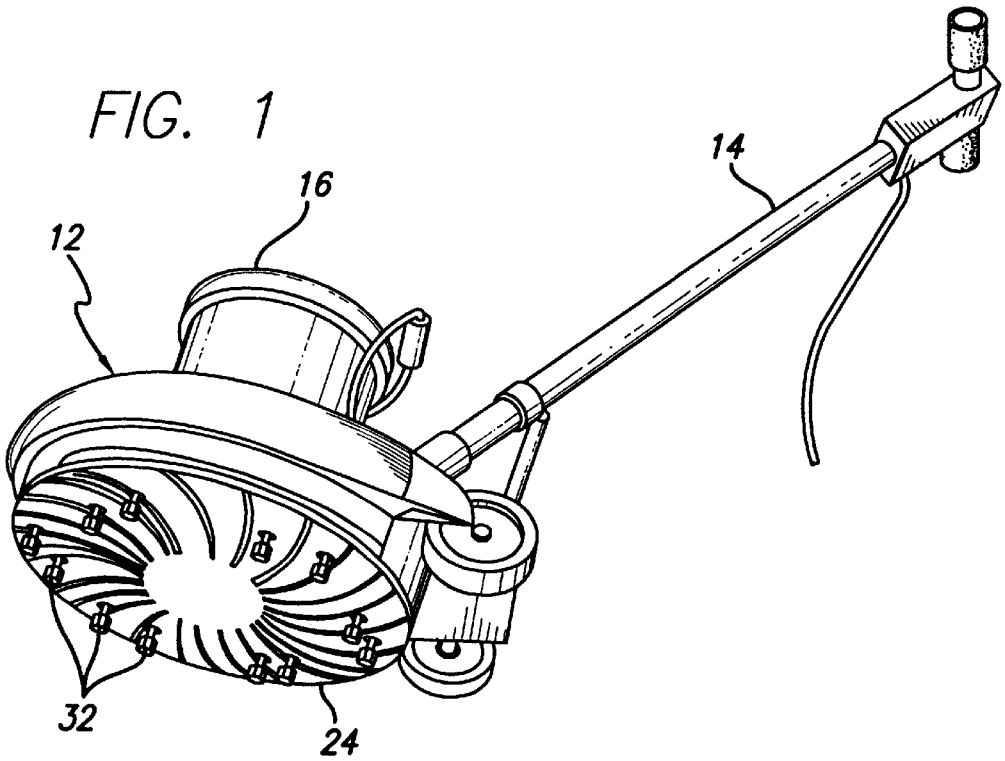
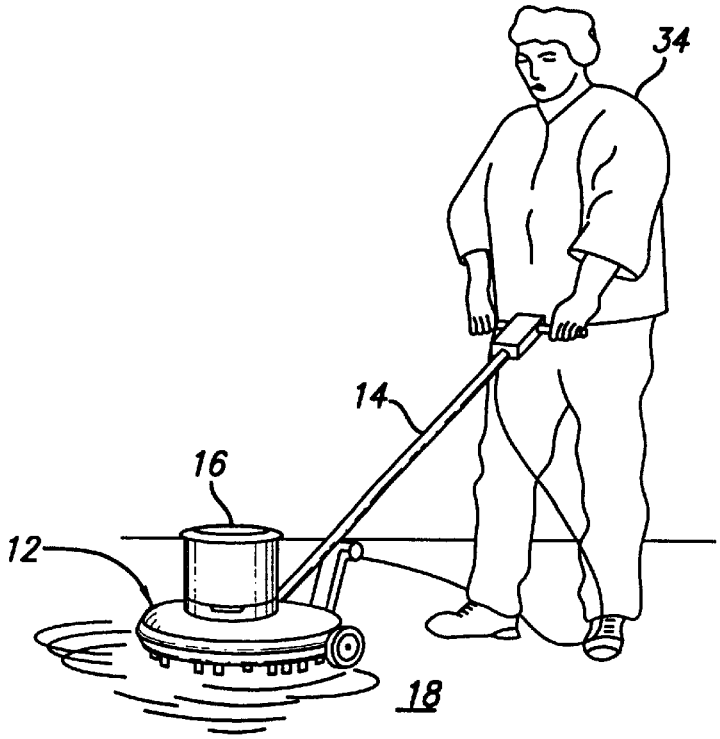
FIG. 2

A
100
102
102
224
224
226
226
202
222
205
209
204
234
232
206
236
232
200
208
244
242
240
210
250
250
248
212
246
216
228
214
110
108
24
228
106
104

234
230
206
258
208
238
242

FIG. 3C
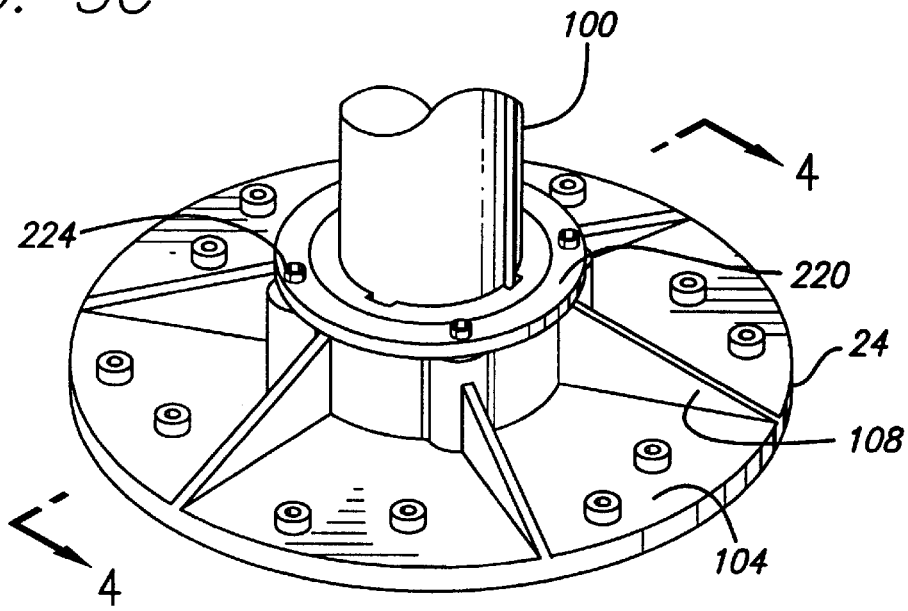
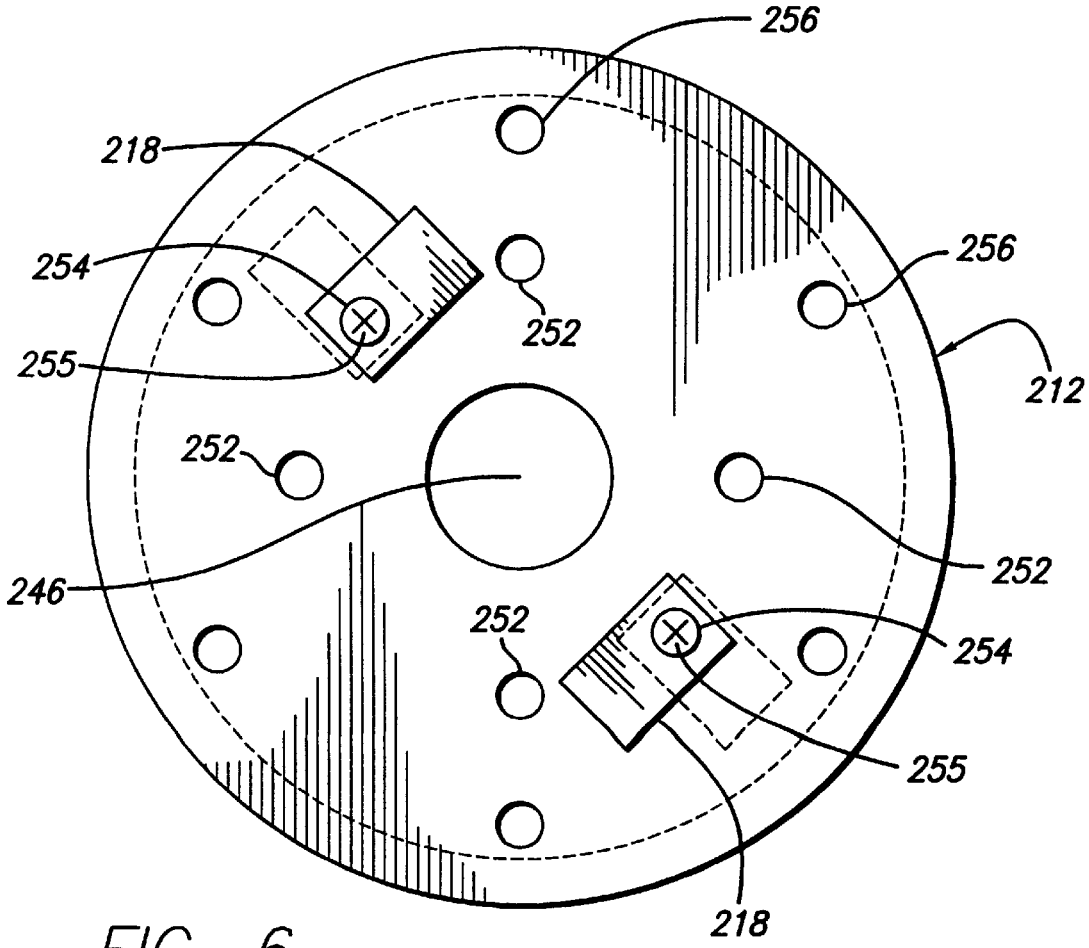
FIG. 6

FLOOR TREATMENT MACHINE WITH TORQUE LIMITER

FIELD OF THE INVENTION

This invention relates generally to floor treatment machines that have rotating heads for the treatment of floor surfaces. More particularly, the present invention relates to a floor treatment machine with a torque overload protection device.

BACKGROUND OF THE INVENTION

Floor treatment machines for polishing, grinding, sanding or otherwise treating surfaces such as concrete or wood floors are well known. U.S. Pat. No. 5,514,027, describes an example of such a floor treatment machine. The floor treatment machine has a handle and a housing containing a motor that rotates a floor treatment head.

In use, the head of the machine rotates on the floor surface that is being treated. The head has twelve pin-type abraders mounted to a disk. When the disk rotates, the abraders sand the surface of the floor. However, the disk can abruptly stop if the abraders contact an obstruction, such as a protrusion on an uneven floor. In stopping abruptly, a torque is applied to the linkage between the motor and the stationary head. This torque can break the linkage or otherwise damage the motor of the floor treatment machine.

U.S. Pat. No. 2,785,424 describes another floor treatment machine that has a centrifugal clutch. While the clutch of this machine is generally effective and is intended to allow the machine's motor to remain spinning when the machine's head hits an obstruction, it has certain drawbacks. In particular, as described at column 9, line 50, the centrifugal clutch is relatively complicated and therefore can be less reliable and more expensive to manufacture and to maintain.

Accordingly, there exists a need for a floor treatment machine with a torque overload protection device that is reliable and inexpensive to manufacture. The present invention solves these problems and provides further related advantages.

SUMMARY OF THE INVENTION

The present invention relates to a floor treatment machine with a torque overload protection device that is reliable and inexpensive to manufacture. A primary advantage of the present invention is associated with improved protection for drive linkage components. The torque from an overload can damage or break individual components of the drive linkage of the floor treatment machine. By limiting the maximum amount of torque applied to the drive linkage, the the floor treatment machine is less likely to be damaged. In addition, the components described below are relatively simple and therefore are less expensive to manufacture and are believed to provide greater reliability.

More particularly, and by way of example only, the floor treatment machine may have a body, a rotating drive linkage, a spinning head for treating the floor surface and a torque limiter assembly. The rotating drive linkage projects from the body and is positioned along a predetermined axis of rotation. The floor treatment head is configured to attach to the drive linkage and the torque limiter assembly is mounted between the floor treatment head and the drive linkage. The torque limiter assembly includes a housing that has a cavity holding two plates.

The first plate is operatively connected to the drive linkage and has a surface positioned normal to the axis of rotation. The second plate is operatively connected to the head and has a surface in opposed alignment with the surface of the first plate. The surface of the second plate is configured to engage the surface of the first plate. The first and the second plate are biased toward each other and are mounted for relative movement away from each other. The surface of the first plate and the surface of the second plate are configured to cooperatively force the plates away from each other upon the application of a torque to the plates.

In a more detailed aspect of the present invention, a spring mounted within the cavity may be used to bias the plates away from each other. In yet another detail, the first and second plates may engage each other via one or more aligned teeth and notches. The plates may be configured with six aligned teeth and notches. In another detailed aspect of the invention, the face of each tooth and notch engage each other in a plane at 45° from the surface of the first plate. This angle of engagement allows the tooth and notch to slip when a torque is applied to the plates, thereby overcoming the bias and moving the plates away from each other to a position where the tooth and notch are disengaged. When the tooth and notch are disengaged, the plates can rotate with respect to each other to relieve the torque load on the drive linkage.

In yet more detailed aspects of the present invention, the surfaces of the plates may be hardened to decrease wear and/or the bias forcing the plates together may be adjustable. Wave springs may be used to provide the bias force. In yet further detailed aspects, the floor treatment machine can include a mechanism that locks the plates together to override the torque limiter assembly components. In particular, one, two, or more tabs can be pivotably mounted within the housing cavity for rotation between a first and a second position. In the first position, the tab does not obstruct the movement of the plates and in the second position the tab does obstruct the movement of the plates away from each other, thereby locking them together.

The invention also is embodied in a floor treatment head with a built-in torque limiter assembly having the plates described above. Because it is attached to the floor treatment head, the benefits of the torque limiter assembly can apply to any floor treatment machine configured to engage the head. The detailed features described above may be included in the floor treatment head.

Another advantage of the present invention is associated with the improved safety. Since the torque limiter assembly disengages the head from the drive linkage, the floor treatment machine is less likely to spin or otherwise move erratically if the head suddenly stops spinning because of a floor surface obstruction.

Still another advantage of the present invention is associated with a loud noise that occurs when the first and second plates disengage. This noise immediately notifies the user of an excess torque situation. After the user remedies the overload, the plates in the torque limiter assembly automatically re-engage.

Other features and advantages of the present invention shall become apparent from the following description of the preferred embodiment, taken in conjunction with the accompanying drawings, which illustrate, by way of example, the principles of the inventions.

BRIEF DESCRIPTION OF THE DRAWINGS

FIG. 1 is a perspective view of a floor treatment machine according to the prior art;

FIG. 2 is a perspective view of an individual operating the floor treatment machine of FIG. 1;

FIG. 3C is a perspective view of the floor treatment head of FIG. 3A;

FIG. 6 is a top plan view of an optional locking mechanism for the head of FIG. 3A; and

DESCRIPTION OF THE PREFERRED EMBODIMENT

Figures 3A, 3B:
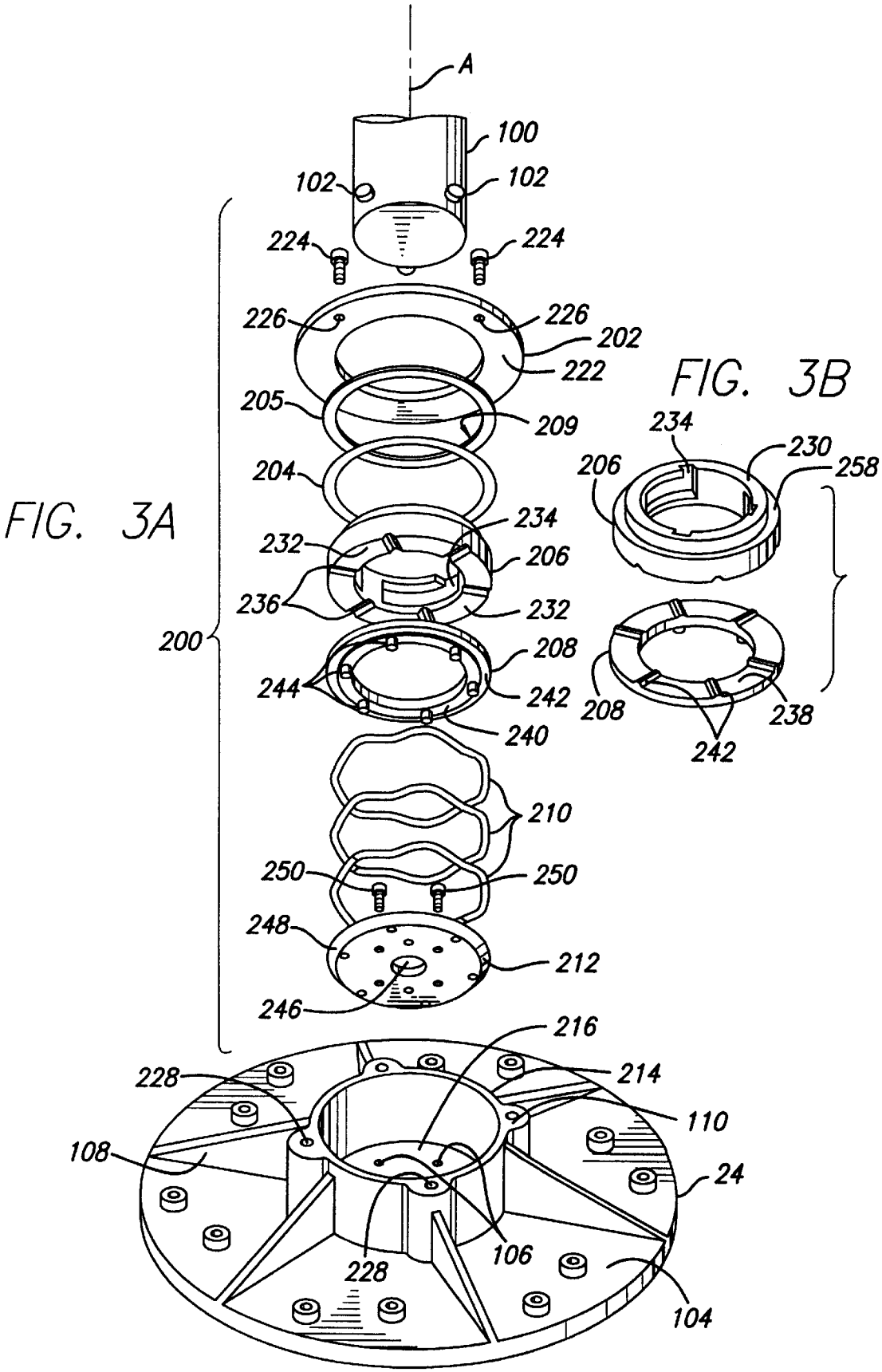
FIG. 3A is an exploded view of a floor treatment head according to the present invention.
FIG. 3B is an exploded view of two plates from FIG. 3A, taken from a different perspective.

As shown in the exemplary drawings, and particularly FIGS. 1 and 2, the present invention is embodied in a floor treatment machine 12 with a torque limiter assembly 200. The floor treatment machine has a control handle 14 and a drive motor 16 operatively connected to a drive linkage 100 that spins a floor treatment head 24 across a floor surface 18. The torque limiter assembly is mounted between the head and the machine's drive linkage.

As shown in FIGS. 3A–C, the drive linkage 100 protrudes from the bottom of the machine 12 and has three protrusions 102 for engaging the torque limiter assembly 200, as will be described in more detail below. The drive linkage rotates about axis A. It should be appreciated that the torque limiter assembly could be configured to work with drive linkages having different configurations.

The floor treatment head 24 has a disc-shaped body configured to hold abraders 32 that sand the floor surface 18. A cylindrical housing 214 projects from the upper surface 104 of the head's body to define a cylindrical cavity sized to accept the components of the torque limiter assembly 200 therein. The cavity preferably is 4.5 cm. deep, has a 6 cm. radius, and a flat bottom surface 216 with four evenly-distributed threaded holes 106 spaced 3 cm. from the center of the head, which is aligned with Axis A. The housing also has a flat top surface 110 with four threaded holes 228. Support webs 108 extend from the outside surface of the housing to the upper surface of the head's body.

The floor treatment head 24 preferably is manufactured by casting an aluminum 356-T6 or 319-T51 material, although other manufacturing methods could be used. Alternatively, other materials could be used, such as steel or other materials of suitable strength and rigidity. The detailed features on the housing are created by drilling and milling the casting. A powder coating can then be applied to the head, as is known in the industry.

As viewed from top to bottom, the torque limiter assembly 200 includes a retaining ring 202, a centering ring 205, a friction-reducing ring 204, a ring-shaped drive plate 206, a ring-shaped slip plate 208, a disc-shaped base plate 212, three wave springs 210, and two lock-out tabs 218 (FIG. 6). Unless otherwise indicated, the components of the torque limiter assembly can be made by investment casting (with suitable finish machining) of 4340 steel or other material of suitable strength, hardness, and durability.

The retaining ring 202 is sized to hold the torque limiter assembly components in the cavity of the housing 214. The retaining ring preferably is rigid and flat and has an upper surface 220 and a lower surface 222. The retaining ring is attached to the top surface 110 of the housing 214 by four threaded fasteners 224. In particular, the retaining ring preferably has a 8.26 cm. exterior radius, a 5.35 cm. radius central hole, and four smaller holes 226 aligned with the holes 228 in the upper surface of the housing. The fasteners pass through the retaining ring holes and engage the holes in the top surface of the housing. The drive linkage 100 of the floor treatment machine fits through the central hole in the retaining ring to connect to the drive plate 206.

The drive plate 206 is located below the retaining ring 202 in the cavity of the housing 214. The drive plate preferably has a flat, circular ring shape with a curved, radially-outer surface having a radius of approximately 5.91 cm. The drive plate also has a central 4.02 cm. radius hole, an upper surface 230, a lower surface 232 and a shoulder 258 between the upper surface and the radially-outer curved surface. The drive plate preferably is 3.11 cm. thick. The shoulder is sized to allow the upper surface of the drive plate to fit into central hole of the retaining ring, thereby positioning the upper surface of the drive plate flush with the upper surface 220 of the retaining ring.

The central hole of the drive plate 206 is configured to connect to the three projections 102 on the drive linkage 100 of the floor treatment machine 12. In particular, the hole has three channels 234, each extending downwardly from a cutout sized to accept a projection. Each channel further extends along the inner circumference of the hole to engage an associated one of the projections on the drive linkage to the drive plate. The lower surface 232 of the drive plate 206 has six symmetrically positioned notches 236 for engagement with the slip ring 208. Each notch has two engagement faces that are positioned in planes that are positioned at 45° degree angles from the lower surface of the drive plate.

The friction-reducing ring 204 is nested on the shoulder 258 of the drive plate 206, located between the drive plate and the retaining ring 202. The friction reducing ring is a shim made of spring steel material or other suitable material. However, it is to be understood that the scope of the invention includes other forms and degrees of hardening as well as friction control devices, such as bearings and the like.

Immediately above the friction reducing ring 204 is a centering ring 205 that sits on a shoulder 207 adjacent to the top surface 110 of the housing 214. The radially inner surface 209 of the centering ring bears on the drive plate 206 to maintain it in a centered position about the axis A.

The slip plate 208 is positioned under the drive plate 206. The slip plate has a flat ring shape, with an upper surface 238, a lower surface 240 and a central hole having a radius of 4.10 cm. The slip plate preferably has a 5.91 cm. outer radius and is 0.86 cm. thick. The upper surface 238 of the slip plate has six teeth 242 spaced apart and configured to engage the notches 236 on the lower surface 232 of the drive plate 206. Each tooth has a frustum shape with an approximately 0.95 cm. base, a 0.32 cm. top, and face or engagement surfaces positioned at an angle of 45° from the upper surface of the slip plate.

The lower surface 240 of the slip plate 208 has six symmetrically-spaced holes and a radially-outer shoulder 242 that is 0.74 cm. wide and 0.19 cm. deep. Each hole has a 0.64 cm. diameter and is located 4.78 cm. from the center of the central hole. Six projections 244 in the shape of 0.64 cm. diameter cylindrical dowels are press fit into each of the six cavities. Each dowel extends 0.76 cm. from the bottom surface of the slip plate. The diameter of the holes is sufficient to provide its associated dowel with a tight press fit. The dowels have a hardness of 60 Rockwell C.

Alternatively, projections of various shapes and sizes could be used, provided that the holes are altered to accommodate the selected shape. The projections may also be cast in various shapes as an integral part of the slip plate instead of the press fit arrangement described above. The upper surface 238 of the slip plate and the lower surface 232 of the drive plate are heat treated to a hardness of 60 Rockwell C. However, as may be required in particular applications, the hardness can be varied. The projections are configured to slidably engage the base plate 212 and thereby allow the slip plate to slide vertically downward, against the bias of the wave springs 210.

The base plate 212 preferably has a 5.91 cm. exterior radius, is 0.64 cm. thick, and rests upon the bottom surface 216 of the housing 214. The base plate is rigid, has a centrally-located hole 246, and approximately a 45° bevel 248 on its lower circumference. This central hole allows coolant flow from the machine 12 to the head 24 if a coolant system were employed with the floor treatment head 24. The base plate is attached to the housing by four threaded fasteners 250 that extend through four countersunk holes 252 aligned with the four threaded holes 106 in the bottom surface 216 of the housing 214. Two additional holes 254 are located in the base plate and are each threaded to engage a ¼-20 screw 255. These screws are used to attach the lock-out tabs 218 described below.

The base plate 212 also has holes 256 that allow the sliding engagement of the projections 244 on the slip plate 208 so the slip plate can move downwardly from and disengage with the drive plate 206 during a torque overload. In this regard, six equally-spaced 0.67 cm. diameter holes 256 are located toward the outer periphery of the base plate, in alignment with the projections extending downwardly from the lower surface 240 of the slip plate. The projections slidably move in these holes. Because the projections can be configured in various shapes, the six holes can also be configured in different shapes to slidable accept the projections. Therefore, it is understood that the holes in the base plate may be modified to engage other projection configurations.

The wave springs 210 are positioned between the slip plate 208 and the base plate 212 and bias the slip plate and the drive plate 206 toward each other. The wave springs are ring shaped and are located radially outwardly from the projections 244 extending from the lower surface 240 of the slip plate 208. The wave springs can be made of spring steel or any other suitable material. Alternatively, other types of springs or mechanisms could be used to bias the drive and slip plates together. Alternatively, spacer pads [not shown] can be located between the base plate 212 and the bottom surface of the housing 216. Depending on the vertical dimensions of the components of the torque limiter assembly 200 used for a particular application, such spacer pads can be used to vary the spacing for the wave springs and thereby change their spring-bias force.

As shown in FIG. 6, the two lock-out tabs 218 allow a user to fix the slip plate 208 to the drive plate 206, thereby disabling the torque limiter assembly 200. Each tab has a thickness slightly less than space between the slip plate and the base plate 212 so that the tab can pivot into that space to limit the downward movement of the base plate. Each tab is pivotably attached to the top of the base plate by fasteners 255. To allow operation of the torque limiter assembly 200, the lock out tabs are positioned to allow the unobstructed vertical movement of the second plate, as shown by the solid lines of FIG. 6. To disable the torque limiter assembly, the tabs are rotated approximately ninety degrees to a position between the slip and base plates, as shown by the phantom lines of FIG. 6. When the lock-out tabs are so positioned, the slip plate and the drive plate 206 cannot disengage. Depending on the dimensions and configurations of the base and slip plates, the size and configuration of the lock-out tabs may be modified.

Figure 4:
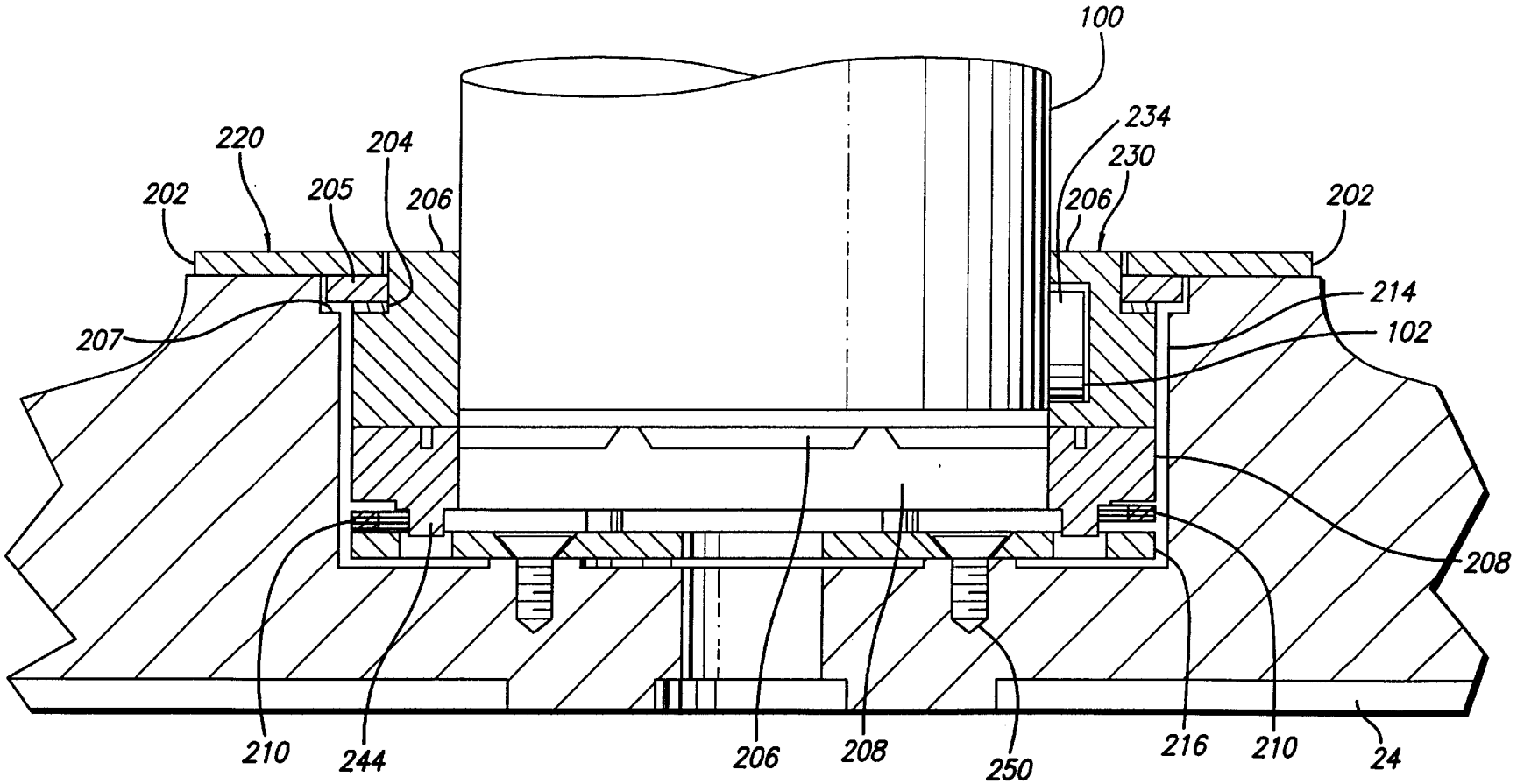
FIG. 4 is a cross-sectional view of the floor treatment head of FIG. 3C, taken about lines 4—4 of FIG. 3C and showing the two plates of FIG. 3A in an engaged position.
Figure 5:
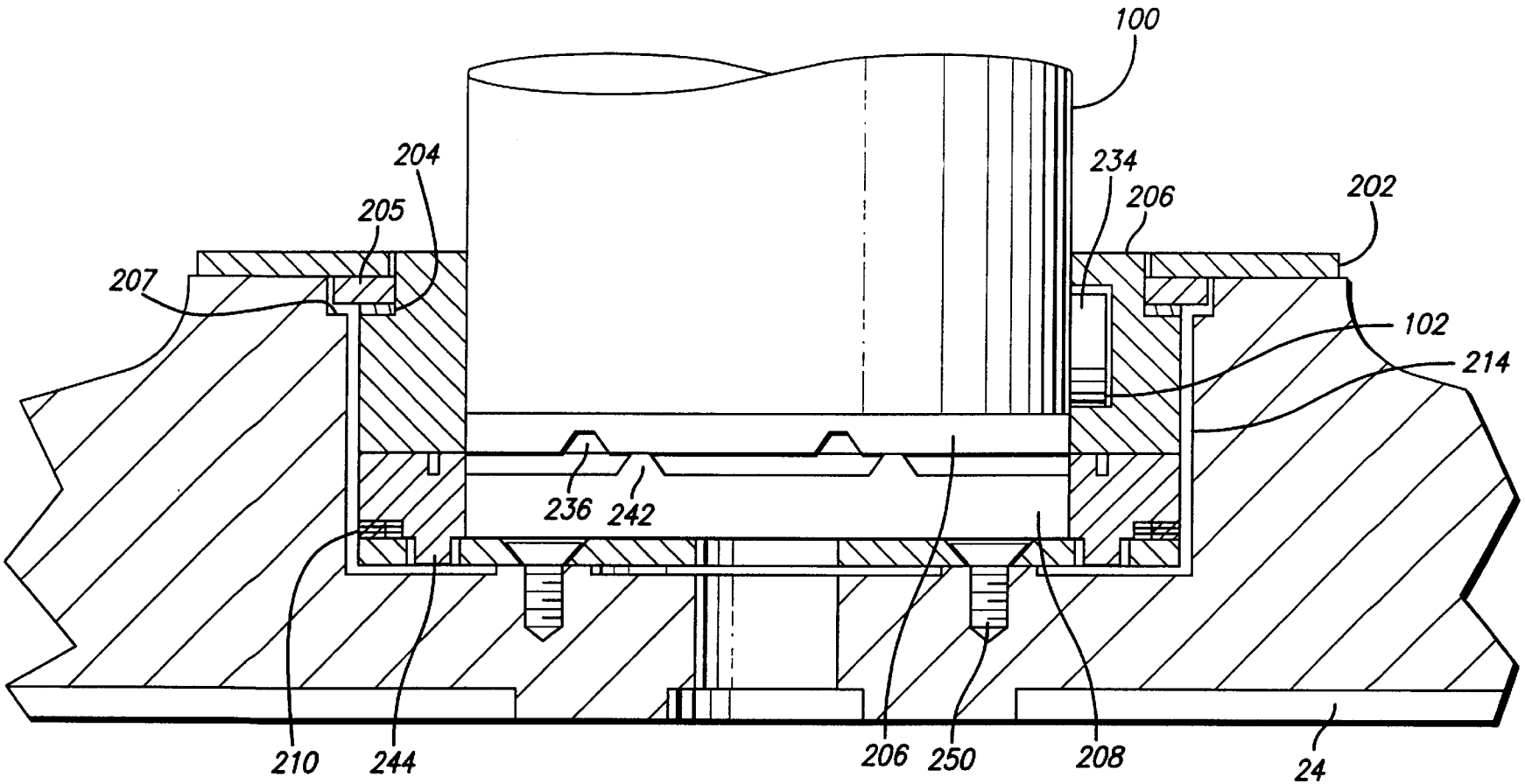
FIG. 5 is a cross-sectional view of the floor treatment head of FIG. 4, showing the two plates in a disengaged position.

With reference to FIGS. 4 and 5, the use of the floor treatment machine 12 will now be described. In normal operation, the torque limiter assembly 200 transfers torque from the drive linkage 100 of the floor treatment machine to spin the floor treatment head 24. First, the floor treatment head containing the torque limiter assembly is attached to the drive linkage of the floor treatment machine by inserting the drive linkage through the retaining ring 202. The head is then twisted to engage the projections 102 on the drive linkage with the channels 234 in the hole of the drive ring 206.

After the head 24 is attached to the machine 12, the machine operator 34 positions the assembled machine over the area of the floor 18 to be treated. The operator grasps the control handle 14, and activates the machine, causing the head to spin. In normal operation, the notches 236 of the drive plate 206 are nested on the teeth 242 of slip plate 208, as illustrated in FIG. 4. When the spinning head encounters a surface obstruction that inhibits the spinning of the head, the torque on the drive and slip plates will increase. When the torque exceeds a predetermined level, the spring-bias forcing the drive and slip plates together is overcome by the vertical force component from the torque acting on the engagement faces of the teeth and notches. When the spring-bias force is overcome, the slip and drive plates disengage, as illustrated by FIG. 5. Upon disengagement, there is relative motion between the drive and slip plates, thereby relieving the torque applied to the drive linkage 100 and other components of the machine. The drive and slip plates of the torque limiter assembly 200 preferably will disengage when the torque level exceeds 80 foot-pounds. However, the disengagement torque may be varied by altering the spring bias force. After the operator remedies the overload, the plates in the torque limiter assembly automatically re-engage.

A primary advantage of the floor treatment machine 12 is associated with improved protection for its drive linkage components. The torque from an overload can damage or break individual components of the drive linkage 100 of the floor treatment machine. By limiting the maximum amount of torque applied to the drive linkage, the floor treatment machine is less likely to be damaged. In addition, the components described above are relatively simple, thereby reducing manufacturing cost and tending to provide greater reliability. The torque limiter assembly 200 also advantageously carries the weight of the floor treatment machine while also functioning as a torque overload protector.

It should be appreciated that the components described above need not be ring-shaped. The components can have other shapes as needed for particular applications.

While a particular form of the invention has been illustrated and described, it will be apparent that various modifications can be made without departing from the spirit and scope of the invention. Accordingly, it is not intended that the invention be limited, except as by the appended claims.

What is claimed is:

1. A floor treatment machine comprising:

a body;

a rotating drive linkage projecting from the body, the drive linkage positioned along a predetermined axis of rotation;

a floor treatment head configured to attach to the drive linkage; and a torque limiter assembly mounted between the floor treatment head and the drive linkage, the torque limiter assembly including a housing having an interior surface defining a cavity, a first plate located within the cavity and operatively connected to the drive linkage, the first plate having a surface positioned normal to the axis of rotation, a second plate operatively connected to the head and having a surface in opposed alignment with the surface of the first plate and configured to engage the surface of the first plate, wherein the first and the second plate are mounted for relative movement away from each other, and at least one spring that biases the first and second plates toward each other, wherein the surface of the first plate and the surface of the second plate are configured to cooperatively force the plates away from each other upon an application of a predetermined amount of torque.

2. The floor treatment machine of claim 1, wherein the surface of one of the plates defines at least one notch and the surface of the other plate has at least one tooth configured to engage the notch, each tooth and notch configured to cooperatively force the plates away from each other upon the application of a torque to the plates.

3. The floor treatment machine of claim 2, wherein one of the plates defines six notches and the other plate defines six teeth, each tooth located to engage an associated one of the notches.

4. The floor treatment machine of claim 2, wherein each tooth and notch has an engagement face in a plane at an angle of 45 degrees from the respective plate surface.

5. The floor treatment machine of claim 1, wherein the surfaces of the first and second plates are hardened.

6. The floor treatment machine of claim 1, wherein the spring is a wave spring.

7. The floor treatment machine of claim 1, further comprising at least one tab pivotably mounted within the cavity for rotation between a first and a second position, wherein in the first position, the tab does not obstruct the movement of the plates and wherein in the second position the tab does obstruct the movement of the plates away from each other.

8. The floor treatment machine of claim 7, wherein two tabs are pivotably mounted within the cavity for rotation in a location between the second plate and the head.

9. A floor treatment machine comprising:

a body;

a rotating drive linkage projecting from the body, the drive linkage positioned along a predetermined axis of rotation;

a floor treatment head configured to attach to the drive linkage; and a torque limiter assembly mounted between the floor treatment head and the drive linkage, the torque limiter assembly including a housing having an interior surface defining a cavity, a first plate located within the cavity and operatively connected to the drive linkage, the first plate having a surface positioned normal to the axis of rotation, a second plate having a surface in opposed alignment with the surface of the first plate and configured to engage the surface of the first plate, the surface of the first plate and the surface of the second plate further being configured to cooperatively force the plates away from each other upon an application of a torque to the plates, wherein the housing has an end surface defining a plurality of holes in opposed alignment with one of the plates, and wherein that plate has a plurality of projections extending parallel to the axis of rotation and in opposed alignment with the housing holes for slidable engagement therewith to allow relative movement of the plates away from each other, and at least one spring mounted adjacent to the end surface of the housing to bias the plates toward each other.

10. The floor treatment machine of claim 9, wherein the surface of one of the plates defines at least one notch and the surface of the other plate defines at least one tooth configured to engage the notch, the tooth and notch configured to cooperatively force the plates away from each other upon the application of a torque to the plates.

11. The floor treatment machine of claim 10, wherein the surface of one plate defines six notches and the surface of the other plate defines six teeth, each tooth located to engage an associated one of the notches.

12. The floor treatment machine of claim 10, wherein each tooth and notch has an engagement face in a plane at an angle of 45 degrees from the respective plate surface.

13. The floor treatment machine of claim 9, wherein the surfaces of the first and second plates are hardened.

14. The floor treatment machine of claim 9, wherein the spring has a plurality of wave-shaped members.

15. The floor treatment machine of claim 9, wherein a shim is positioned inside of the cavity adjacent to the first plate.

16. The floor treatment machine of claim 9, further comprising at least one tab pivotably mounted within the cavity for rotation between a first and a second position, wherein in the first position the tab does not obstruct the movement of the plates, and wherein in the second position the tab interferingly engages one of the plates upon the movement of the plates away from each other.

17. The floor treatment machine of claim 16, wherein two tabs are pivotably mounted within the cavity for rotation in a location between the second plate and the end surface of the housing, the rotation of the tabs oriented in a plane perpendicular to the axis of rotation.

18. A head for a floor treatment machine, the floor treatment machine of a type having a rotating drive linkage to rotate the head about a predetermined axis of rotation, the head comprising:

a body;

a housing located on the body and having an interior surface defining a cavity; and a torque limiter assembly mounted in the cavity of the housing, the torque limiter assembly including a first plate located within the cavity and configured for operatively connecting to the drive linkage, the first plate having a surface positioned normal to the axis of rotation, a second plate operatively connected to the body and having a surface in opposed alignment with the surface of the first plate and configured to engage the surface of the first plate, wherein the first and the second plate are mounted for relative movement away from each other, and at least one spring that biases the first and second plates together, wherein the surface of the first plate and the surface of the second plate are configured to cooperatively force the plates away from each other upon an application of a torque to the plates.

19. The head of claim 18, wherein the surface of one of the plates defines at least one notch and the surface of the other plate has at least one tooth configured to engage the notch, the tooth and notch configured to cooperatively force the plates away from each other upon the application of a torque to the plates.

20. The head of claim 19, wherein one of the plates defines six notches and the other plate defines six teeth, each tooth located to engage an associated one of the notches.

21. The head of claim 19, wherein each tooth and notch has an engagement face in a plane at an angle of 45 degrees from the respective plate surface.

22. The head of claim 18, wherein the surfaces of the first and second plates are hardened.

23. The head of claim 18, wherein the spring is a wave spring.

24. The head of claim 18, further comprising at least one tab pivotably mounted within the cavity for rotation between a first and a second position, wherein in the first position the tab does not obstruct the relative movement of the plates away from each other, and wherein in the second position the tab interferingly engages one of the plates upon the movement of the plates away from each other.

25. The head of claim 24, wherein two tabs are pivotably mounted within the cavity for rotation in a location between the second plate and the end surface of the housing, the rotation of the tabs oriented in a plane perpendicular to the axis of rotation.

* * * * *

UNITED STATES PATENT AND TRADEMARK OFFICE

CERTIFICATE OF CORRECTION

PATENT NO. : 6,231,432 B1
DATED : May 15, 2001
INVENTOR(S) : Clayton Peterson et al.

It is certified that error appears in the above-identified patent and that said Letters Patent is hereby corrected as shown below:

Column 2,
Line 12, "away" should be -- toward --.

Signed and Sealed this

Twenty-second Day of January, 2002

*Attest:*

*Attesting Officer*

JAMES E. ROGAN
*Director of the United States Patent and Trademark Office*